US011783696B2

(12) United States Patent
Golob et al.

(10) Patent No.: US 11,783,696 B2
(45) Date of Patent: Oct. 10, 2023

(54) FIRE DETECTION SYSTEM DIAGNOSTIC SYSTEMS AND METHODS

(71) Applicant: Carrier Corporation, Palm Beach Gardens, FL (US)

(72) Inventors: Michael Lawrence Golob, Bradenton, FL (US); Juan F. Posada, Bradenton, FL (US); Dennis Michael Gadonniex, Bradenton, FL (US)

(73) Assignee: Carrier Corporation, Palm Beach Gardens, FL (US)

( * ) Notice: Subject to any disclaimer, the term of this patent is extended or adjusted under 35 U.S.C. 154(b) by 0 days.

(21) Appl. No.: 17/632,974

(22) PCT Filed: Sep. 29, 2020

(86) PCT No.: PCT/US2020/053247
§ 371 (c)(1),
(2) Date: Feb. 4, 2022

(87) PCT Pub. No.: WO2021/076318
PCT Pub. Date: Apr. 22, 2021

(65) Prior Publication Data

US 2022/0277643 A1 Sep. 1, 2022

Related U.S. Application Data

(60) Provisional application No. 62/923,034, filed on Oct. 18, 2019.

(51) Int. Cl.

| | |
|---|---|
| ***G08B 29/14*** | (2006.01) |
| ***G08B 17/113*** | (2006.01) |
| ***G08B 29/12*** | (2006.01) |

(52) U.S. Cl.
CPC ..... *G08B 29/145* (2013.01); *G08B 17/113* (2013.01); *G08B 29/123* (2013.01)

(58) Field of Classification Search
CPC ... G08B 29/145; G08B 17/113; G08B 29/123
See application file for complete search history.

(56) References Cited

U.S. PATENT DOCUMENTS

| | | | |
|---|---|---|---|
| 4,847,780 | A | 7/1989 | Gilker et al. |
| 4,849,691 | A | 7/1989 | Siefers |

(Continued)

FOREIGN PATENT DOCUMENTS

| | | |
|---|---|---|
| CN | 2667586 Y | 12/2004 |
| EP | 2706518 A1 | 3/2014 |

(Continued)

OTHER PUBLICATIONS

International Preliminary Report on Patentability for International Application No. PCT/US2020/053247 dated Apr. 19, 2022.

*Primary Examiner* — Nay Tun
(74) *Attorney, Agent, or Firm* — Carlson, Gaskey & Olds, P.C.

(57) ABSTRACT

A tool for performing diagnostics on a fire detection system includes an induction coil which includes two halves that may be selectively opened and closed to surround a wire in the system and sense current through the wire. A diagnostic module and a conduit provide communication of data of the sensed current between the induction coil and the diagnostic module. The diagnostic module is configured to decode the data to interpret communications sent through the wire.

15 Claims, 4 Drawing Sheets

(56) References Cited

U.S. PATENT DOCUMENTS

| | | | | |
|---|---|---|---|---|
| 4,914,399 | A * | 4/1990 | Doany | H03F 3/2171 330/10 |
| 5,029,188 | A | 7/1991 | Lexa | |
| 5,039,970 | A * | 8/1991 | Cox | G01R 1/22 336/107 |
| 5,189,319 | A | 2/1993 | Fung et al. | |
| 6,566,855 | B1 | 5/2003 | Nguyen et al. | |
| 7,075,289 | B2 * | 7/2006 | Chen | H04Q 9/00 324/142 |
| 7,288,929 | B2 * | 10/2007 | Prsha | G01V 3/081 324/127 |
| 8,175,463 | B2 * | 5/2012 | Elberbaum | G08C 23/06 398/141 |
| 8,421,475 | B2 | 4/2013 | Thiim | |
| 9,165,709 | B2 * | 10/2015 | Thorner | G01R 15/186 |
| 9,633,554 | B1 | 4/2017 | Barson | |
| 9,970,975 | B2 * | 5/2018 | Bango | G01R 15/186 |
| 11,193,958 | B2 * | 12/2021 | Elliott | G01R 15/06 |
| 11,215,643 | B2 * | 1/2022 | Nakajima | G01R 1/22 |
| 2002/0167303 | A1 | 11/2002 | Nakano | |
| 2008/0231289 | A1 | 9/2008 | Ganesh et al. | |
| 2010/0007354 | A1 | 1/2010 | Deaver, Sr. et al. | |
| 2014/0091807 | A1 * | 4/2014 | Lontka | G01R 31/52 324/509 |
| 2014/0092724 | A1 * | 4/2014 | Lontka | H04L 69/40 370/221 |
| 2016/0231792 | A1 * | 8/2016 | Richter | H04W 4/50 |
| 2016/0322831 | A1 * | 11/2016 | Gilbert | H02M 7/04 |
| 2016/0349295 | A1 * | 12/2016 | Banhegyesi | G01R 21/133 |
| 2019/0289688 | A1 * | 9/2019 | Banhegyesi | H04B 10/808 |

FOREIGN PATENT DOCUMENTS

| | | | |
|---|---|---|---|
| GB | 1485117 | A | 9/1977 |
| JP | 4651321 | B2 | 3/2011 |
| JP | 4749277 | B2 | 8/2011 |
| KR | 101410033 | B1 | 6/2014 |
| WO | 9633478 | A1 | 10/1996 |
| WO | 2013058792 | A1 | 4/2013 |

* cited by examiner

FIRE DETECTION SYSTEM DIAGNOSTIC SYSTEMS AND METHODS

CROSS-REFERENCE TO RELATED APPLICATIONS

This application claims priority to U.S. Provisional Application No. 62/923,034, which was filed on Oct. 18, 2019 and is incorporated herein by reference.

BACKGROUND

Fire detection systems are known to detect fires within certain areas. As some examples, these areas may include commercial, residential, educational, or governmental buildings.

These systems may include various devices in communication with one another through a communication network. Some fire detection systems include control panels and fire detection devices, which monitor the areas for indicators of fire. Periodic diagnostics may be performed on some systems to test the functionality of the various components.

SUMMARY

A tool for performing diagnostics on a fire detection system, according to an example of this disclosure, includes an induction coil which includes two halves that may be selectively opened and closed to surround a wire in the system and sense current through the wire. The tool includes a diagnostic module. A conduit provides communication of data of the sensed current between the induction coil and the diagnostic module. The diagnostic module is configured to decode the data to interpret communications sent through the wire.

In a further example of the foregoing, the two halves are hingeably connected.

In a further example of any of the foregoing, each of the two halves includes a ferrous core.

In a further example of any of the foregoing, each of the two halves include a plastic enclosure.

In a further example of any of the foregoing, the diagnostic module includes an interface signal processing board for performing the decoding.

In a further example of any of the foregoing, the interface signal processing board is programmed with an algorithm for converting the sensed data into signals from at least one detector of the system.

In a further example of any of the foregoing, the fire detection system includes a module in communication with a detector through the wire.

In a further example of any of the foregoing, the wire remains connected to the module and the detector throughout the method for monitoring.

In a further example of any of the foregoing, the method includes detecting a dirty detector in the fire detection system based on the decoded data.

In a further example of any of the foregoing, the method includes detecting a lack of communication between a device and a panel of the fire detection system based on the decoded data In a further example of any of the foregoing, the step of surrounding includes opening the induction coil, placing the wire within an inner diameter of the induction coil, and closing the induction coil.

In a further example of any of the foregoing, the induction coil includes two halves.

In a further example of any of the foregoing, the two halves are hingeably connected.

In a further example of any of the foregoing, each of the two halves include a ferrous core.

In a further example of any of the foregoing, each of the two halves include a plastic enclosure.

These and other features may be best understood from the following specification and drawings, the following of which is a brief description.

DETAILED DESCRIPTION

Figure 1:
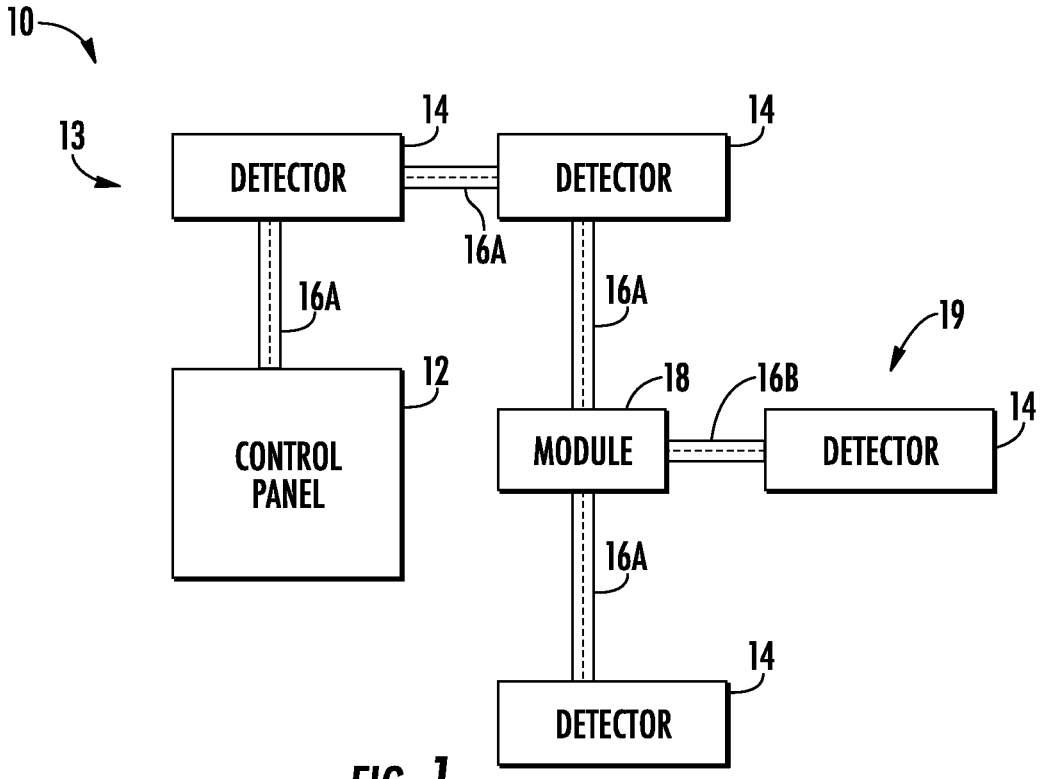
FIG. 1 schematically illustrates an example fire detection system.

FIG. 1 schematically illustrates an example fire detection system 10 configured to detect a fire in a target area and initiate one or more responses based on the detection. In some examples, the target area is within a building or other structure.

In the example fire detection system 10 shown, a control panel 12 is in communication with a first loop 13 of one or more detectors 14 and modules 18 through a wire 16A. The detectors 14 send signals to the control panel 12 through the wire 16A, and the control panel 12 is programmed to make decisions based on the signals. The control panel 12 may send commands to the detectors 14 through the wire 16A. In some examples, the decisions of the control panel 12 may include one or more of the following: sounding an alarm, posting a trouble condition, displaying a wiring fault, and/or contacting a fire department. Although three detectors 14 are shown in the first loop 13 in the illustrative example, more or fewer detectors 14 may be included in some examples. That is, systems with any number of detectors 14 may benefit from this disclosure.

In some examples, as shown, a module 18 may be in communication with a second loop 19 of one or more of the detectors 14 through a wire 16B. In some examples, the module 18 may receive signals from the detectors 14 and communicate outputs to the control panel 12 regarding those signals. In some examples, the module 18 may also be in communication with one or more external devices (not shown) to the system 10, one example being an HVAC system, and may send commands to those external devices. Although one module 18 is shown in the illustrative example, more or fewer modules 18 may be utilized in some examples.

In prior art systems, to perform diagnostics, the wires 16A, 16B would be disconnected from the control panel 12 and/or module 18 and connected to a diagnostic tool. In some examples, because of this disconnection, a user would place the system in a test mode and power down one or more components in the system before connecting diagnostic tools. In some examples, a control panel may be in communication with a central monitoring station, such that "test mode" would inform the central monitoring station that a fault or alarm on the control panel may be due to a technician performing a test. The central monitoring station may then decide to either ignore or verify the problem before taking further action, such as notifying the fire department. In some examples, disconnecting one or more wires would result in powering down a loop of detectors.

Figure 2:
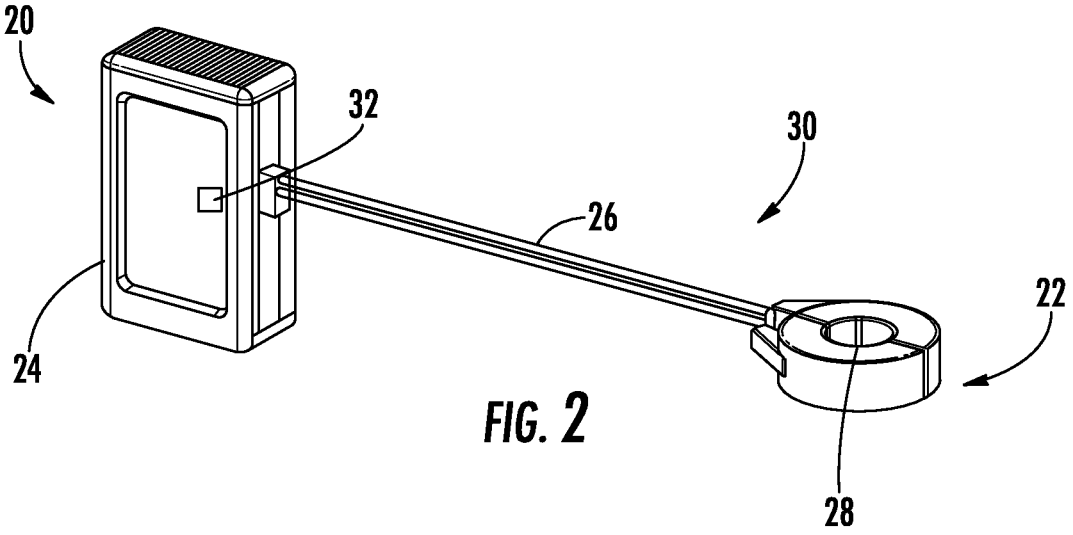
FIG. 2 illustrates an example diagnostic tool.

FIG. 2 illustrates a non-invasive diagnostic tool 20 for performing diagnostics on fire detection systems such as the system 10 shown in FIG. 1. The diagnostic tool 20 includes an induction coil 22 in communication with a diagnostic module 24 through a conduit 26. In some examples, the conduit 26 is rigid. In some examples, the conduit 26 is flexible.

The induction coil 22 forms a ring shape providing an inner diameter 28 configured to surround a wire for sensing communications across the wire. The terms "ring" and "diameter" do not necessarily connote a rounded or circular shape, as other shapes are contemplated. In some examples, the communications are sequences of current pulses. The induction coil 22 communicates the sensed information to the diagnostic module 24 through the conduit 26. In some examples, the induction coil 22 and the conduit 26 form an attachment portion 30 that may be integrated with existing diagnostic modules.

Figure 3:
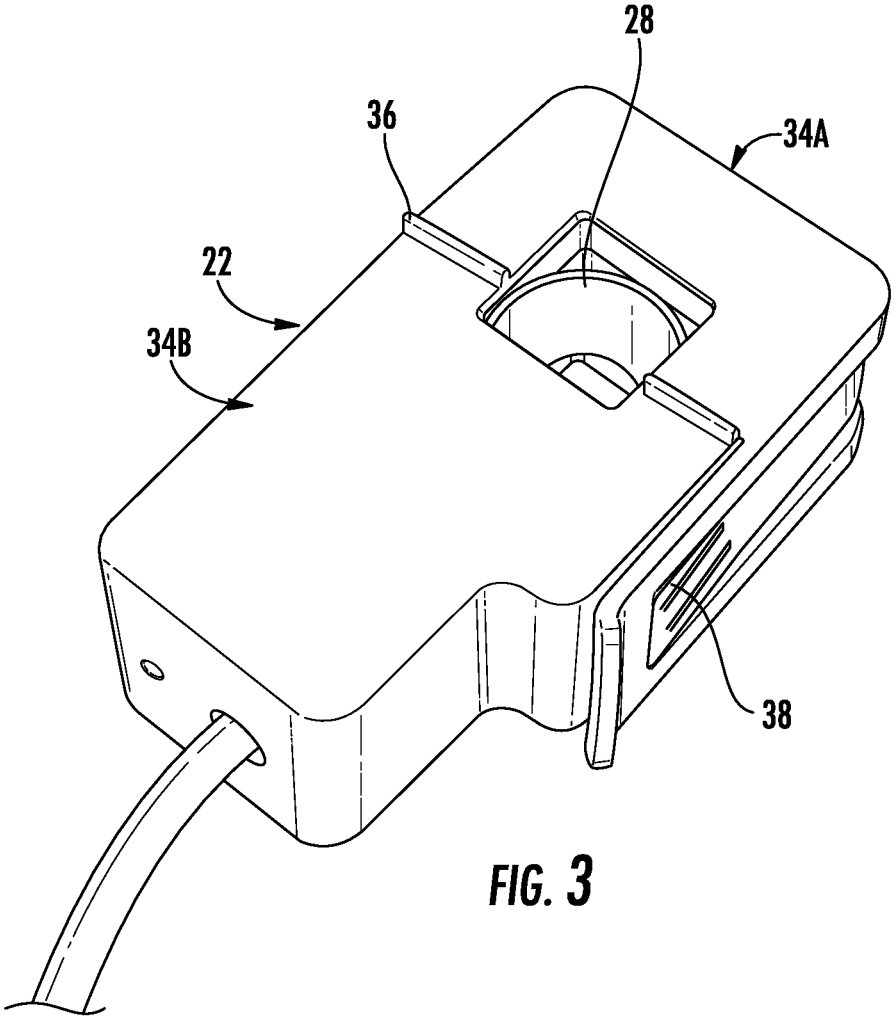
FIG. 3 illustrates an example induction coil of the example diagnostic tool of FIG. 2.

FIG. 3 illustrates an example induction coil 22. Two halves 34A and 34B are connectable to form the inner diameter 28 that surrounds a monitored wire (not shown). In some examples, as shown, the halves 34A and 34B may be selectively opened and closed through a hinge connection 36 and latch 38. A person of ordinary skill in the art having the benefit of this disclosure would recognize that other connection types may be utilized. In some examples, the halves 34A and 34B may include ferrous core interiors and plastic enclosures. One of the halves 34A, 34B may include a number of turns of insulated wire wrapped around the ferrous core, so as to create a transformer-like device. The coil 22 effectively senses the current from a monitored wire and creates a current on the wire of the transformer-like device. In some examples, this current may then be passed through a resistor (not shown) to create a voltage that can be measured.

Figure 4:
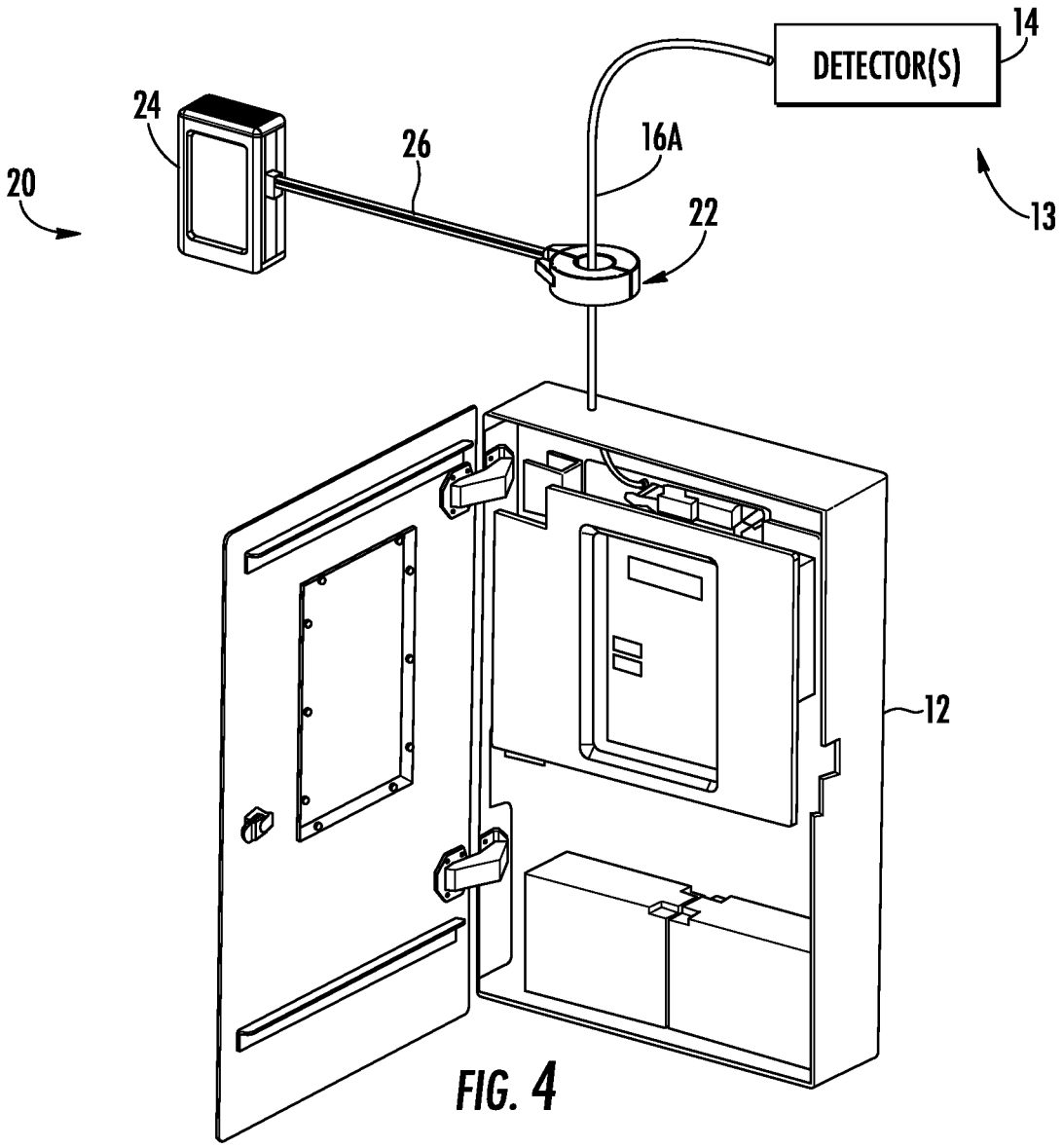
FIG. 4 illustrates the example tool of FIG. 2 positioned to perform diagnostics on the system of FIG. 1.
Figure 5:
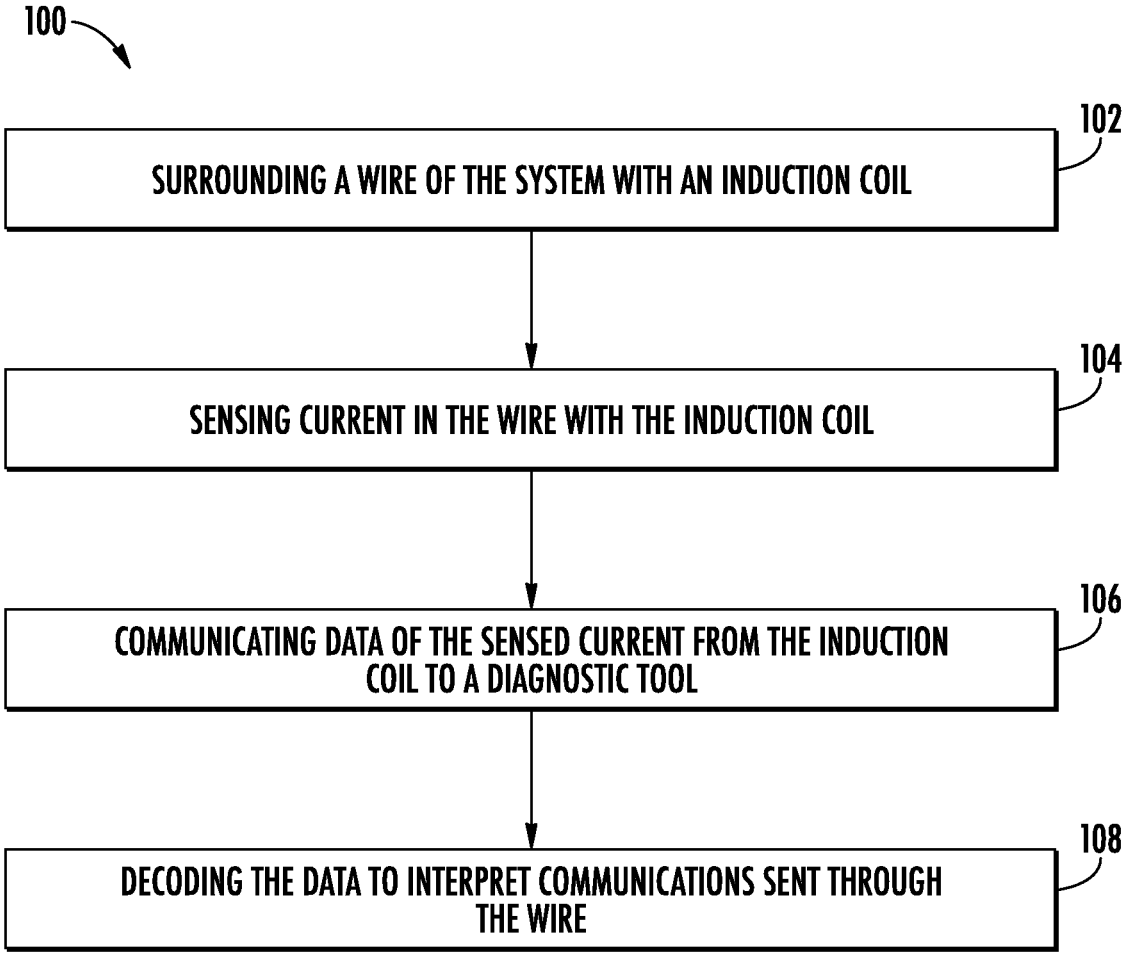
FIG. 5 illustrates a flowchart of a method for monitoring a fire detection system.

FIG. 4 illustrates the example tool 20 of FIGS. 2 and 3 positioned to perform diagnostics on the system 10 of FIG. 1. In the example shown, the induction coil 22 surrounds the wire 16A for sensing communications between the panel 12 and the first loop 13 of detectors 14 (shown schematically) through the wire 16A. The sensed data may then be communicated from the induction coil 22 to the diagnostic module 24 through the conduit 26. The diagnostic module 24 is configured to decode the sensed data to interpret the communications being sent through the wire 16A.

In some examples, the diagnostic module 24 is programmed with an algorithm to decode the sensed data. In some examples, the module 24 includes an interface signal processing board 32 for performing the decoding. In some examples, the algorithm can convert current and/or voltage readings into control panel 12 commands and/or detector 14 signals and responses. In some examples, the commands, signals, and responses can then be used by standard diagnostic tools to troubleshoot a problem. In some examples, data may be saved to a file for analysis after completion of the data collection. In some examples, the decoded data may show one or more of: lack of communication with the control panel 12 (such as through a disconnect in the circuitry in the system, in some examples), dirty detectors 14 (such as dust, insects, or other debris within a chamber of a detector 14 that requires cleaning, in some examples), bad contacts (such as due to corrosion or moisture in the contacts between the loop 13 and the panel 12 or the loop 19 and the module 18, in some examples), Although the example in FIG. 4 shows the diagnostic tool 20 being used on the wire 16A, the diagnostic tool 20 may also be used on the wire 16B (see FIG. 1) for listening to communications between the module 18 and the second loop 19 of detectors 14. In some examples, the detector 14 on the second loop 19 transmit a "clean me" current signal to the module 18 when the detector 14 is in need of cleaning. The diagnostic tool 20 may be configured to interpret the "clean me" signal without disconnection of the wires 16A/16B.

Due to the configuration of the induction coil 22, the tool 20 can listen to communications through the wires 16A, 16B without disconnecting the wires, changing the system 10 to test mode, or power cycling the control panel 12, detectors 14, or module 18. Although one example configuration of the induction coil 22 that allows for selective opening and closing the induction coil 22 is disclosed for inductive coupling to the wire, a person of ordinary skill in the art having the benefit of this disclosure would recognize that other configurations may be utilized.

With reference to FIGS. 1-4, FIG. 5 illustrates a flowchart of an example method 100 for monitoring a fire detection system, such as the fire detection system 10 shown in FIG. 1, for example. At 102, the method 100 includes surrounding a wire of the system with an induction coil. At 104, the method 100 includes sensing current in the wire with the induction coil. At 106, the method 100 includes communicating data of the sensed current from the induction coil to a diagnostic tool. At 108, the method includes decoding the data to interpret communications sent through the wire.

In some examples, the method 100 may include that the communications are commands from a control panel of the fire detection system. In some examples, the method 100 may include that the communications are responses from a detector of the fire detection system. In some examples, the step of encircling does not include disconnection of the wire from the system. In some examples, the wire remains connected to the panel and the detector throughout the method for monitoring. In some examples, the method 100 may include detecting a dirty detector in the fire detection system based on the decoded data. In some examples, the method 100 may include detecting a lack of communication between a device and a panel of the fire detection system based on the decoded data.

Although the different examples are illustrated as having specific components, the examples of this disclosure are not limited to those particular combinations. It is possible to use some of the components or features from any of the embodiments in combination with features or components from any of the other embodiments.

The foregoing description shall be interpreted as illustrative and not in any limiting sense. A worker of ordinary skill in the art would understand that certain modifications could come within the scope of this disclosure. For these reasons, the following claims should be studied to determine the true scope and content of this disclosure.

What is claimed is:

1. A method for monitoring a fire detection system, the method comprising:

surrounding a wire of the system with an induction coil;

sensing current in the wire with the induction coil;

communicating data of the sensed current from the induction coil to a diagnostic tool; and decoding the data to interpret communications sent through the wire, wherein the communications are commands from a panel of the fire detection system or are responses from a detector of the fire detection system.

2. The method as recited in claim 1, wherein the communications are commands from the panel.

3. The method as recited in claim 1, wherein the communications are responses from the detector.

4. The method as recited in claim 1, wherein the step of surrounding comprises maintaining a connection of the wire with the system.

5. The method as recited in claim 1, wherein the fire detection system comprises a panel and a detector in communication through the wire.

6. The method as recited in claim 5, wherein the wire remains connected to the panel and the detector throughout the method for monitoring.

7. The method as recited in claim 1, wherein the fire detection system comprises a module in communication with a detector through the wire.

8. The method as recited in claim 7, wherein the wire remains connected to the module and the detector throughout the method for monitoring.

9. The method as recited in claim 1, wherein the step of surrounding comprises opening the induction coil, placing the wire within an inner diameter of the induction coil, and closing the induction coil.

10. The method as recited in claim 9, wherein the induction coil comprises two halves.

11. The method as recited in claim 10, wherein the two halves are hingeably connected.

12. The method as recited in claim 11, wherein each of the two halves comprises a ferrous core.

13. The method as recited in claim 12, wherein each of the two halves comprises a plastic enclosure.

14. A method for monitoring a fire detection system, the method comprising:

surrounding a wire of the system with an induction coil;

sensing current in the wire with the induction coil;

communicating data of the sensed current from the induction coil to a diagnostic tool;

decoding the data to interpret communications sent through the wire; and detecting a dirty detector in the fire detection system based on the decoded data.

15. A method for monitoring a fire detection system, the method comprising:

surrounding a wire of the system with an induction coil;

sensing current in the wire with the induction coil;

communicating data of the sensed current from the induction coil to a diagnostic tool;

decoding the data to interpret communications sent through the wire; and detecting a lack of communication between a device and a panel of the fire detection system based on the decoded data.

* * * * *